United States Patent [19]

Stanley

[11] Patent Number: 4,934,299

[45] Date of Patent: Jun. 19, 1990

[54] CAMLOCK WINDSURFING MAST FOOT

[75] Inventor: Larry K. Stanley, Goleta, Calif.

[73] Assignee: Windsurfing Hawaii, Inc., Goleta, Calif.

[21] Appl. No.: 321,781

[22] Filed: Mar. 10, 1989

[51] Int. Cl.[5] ..... B63B 15/00

[52] U.S. Cl. ..... 114/93

[58] Field of Search ..... 114/90, 91, 93, 39.2; 411/354

[56] References Cited

U.S. PATENT DOCUMENTS 3,107,571 10/1963 Burg ..... 411/354 X

FOREIGN PATENT DOCUMENTS 3409772 6/1985 Fed. Rep. of Germany ..... 114/39.2

*Primary Examiner*—Sherman D. Basinger

*Attorney, Agent, or Firm*—Donald A. Streck

[57] ABSTRACT

A mast foot assembly for adjustably and releasably holding a mast to a mast track disposed on a surface of a sailing device. A base member is disposed on the upper surface of the mast track and has a pair of first bores at respective ends thereof disposed over the slot. It also has a central mounting portion between the first bores with a second bore therethrough normal to the upper and lower surfaces and having a first slot communicating between a side of the base member and the second bore. There is a retaining key member sized to slidably fit within the first slot in the base member and having a second slot communicating with an inner end thereof. A pair of nut members each having a treaded bore therein are disposed under the lower surface of the mast track. A pair of threaded members are carried by the base member and pass through respective ones of the first bores in threaded engagement with respective ones of the nut members. The threaded members each have a head portion unable to pass through the first bore associated therewith. There is a cylindrical pivot and retaining pin carried by a lower end of the mast having a circumferential groove aligned with the first slot with the mast disposed on the base member with the pin disposed in the second bore. The retaining key member is slidable into the first slot to have portions simultaneously engaged with the first slot and the groove to pivotally retain the pin in the second bore and is slidable out of the first bore to allow the pin and the mast carrying it to be removed from the base portion. Finally, there is a cam handle carried by the base portion with the threaded members passing therethrough for simultaneously creating or releasing a lifting force on the head portion of the threaded members.

8 Claims, 3 Drawing Sheets

CAMLOCK WINDSURFING MAST FOOT

BACKGROUND OF THE INVENTION

The present invention relates to equipment used for the sport of windsurfing, and the like, and, more particularly, to a mast foot assembly for adjustably and releasably holding a mast to a mast track having a slot in a planar member with upper and lower surfaces and disposed on a surface of a sailing device comprising, a base member disposed on the upper surface of the mast track and having a pair of first bores at respective ends thereof disposed over the slot, the base member having a central mounting portion between the first bores with a second bore therethrough normal to the upper and lower surfaces and having a first slot communicating between a side of the base member and the second bore; a retaining key member sized to slidably fit within the first slot in the base member and having a second slot communicating with an inner end thereof; a pair of nut members each having a treaded bore therein disposed under the lower surface of the mast track; a pair of threaded members carried by the base member and passing through respective ones of the first bores in threaded engagement with respective ones of the nut members, the threaded members each having a head portion unable to pass through the first bore associated therewith; a cylindrical pivot and retaining pin carried by a lower end of the mast and having a circumferential groove aligned with the first slot with the mast disposed on the base member with the pin disposed in the second bore, the retaining key member being slidable into the first slot to have portions simultaneously engaged with the first slot and the groove to pivotally retain the pin in the second bore and being slidable out of the first bore to allow the pin and the mast carrying it to be removed from the base portion; and, cam handle means carried by the base portion with the threaded members passing therethrough for simultaneously creating or releasing a lifting force on the head portion of the threaded members.

Windsurfing is a sport that has gained rapid acceptance around the world. As with most such sports, the associated equipment has undergone many improvements since its first introduction in order to make the equipment more useful in a competitive environment. As depicted in FIG. 1, the typical windsurfing board 10 has a 12 mast mounted to its top surface and extending upward therefrom in the manner of many sailing type devices. A so-called wishbone boom 14 extends aft from the mast 12 at about shoulder height to the sailor using the board and a triangular said 16 is mounted between the top and foot of the mast 12 and the aft end of the boom 14 as depicted in the figure. For various reasons which are not important to the present invention, it is desirable to be able to adjust the position of the mast 12 on the board 10 fore and aft as depicted by the arrows 18 in FIG. 1. This is typically accomplished in the manner depicted in FIGS. 2 and 3. A mast track 19 comprised of a hollow box 20 having a longitudinally slot 22 in the top thereof is embedded into the top surface of the board 10 during the manufacture thereof. In the simplest prior art approach as depicted in the figures, a bolt 24 is embedded in the end of the mast 12 to extent outward longitudinally therefrom. Typically, the end of the mast 12 is fitted with a flexible mast joint; however, this is not critical to the discussion and invention here. Where there is a mast joint, the bolt 24 would be embedded therein and project therefrom. A matching nut 26 is disposed within the box 20. The bolt 24 is passed through the slot 22 into threaded engagement with the nut 26. By twisting the mast 12 in a clockwise direction, the nut 26 can be drawn tight against the inside of the top of the box 20 to hold the mast 12 in a given position. By twisting the mast 12 in a counterclockwise direction, the nut 26 can be loosened sufficiently to allow the mast 12 and nut 26 to be slid fore and aft along the slot 22.

Over the past few years as the sport of windsurfing has gained extreme popularity, various attempts have been made to simplify the task of adjusting the position of the mast foot on the surface of the board. Most, if not all, employ variations of the basic box and slot approach described above. Examples of such prior art approaches varying from the simple to the ridiculous can be found with reference to the following U.S. Pat. Nos. 4,730,568 (Campbell); 4,718,367 (Camp et al.); 4,573,423 (Dumortier); 4,526,120 (Gaide); 4,449,466 (Marker et al.); 4,528,926 (Brockhaus et al.); 4,700,649 (Schotz); 4,740,182 (Pertramer); 4,273,062 (Marker et al.); and 4,455,959 (Suzuki).

While some of these devices may work for the single task of adjustably affixing the foot of the mast 12 to the top of the board 10, other necessary attributes of a truly useful system are generally lacking. For one, such adjustments to the mast position are often accomplished on the water where the sailor does not have the benefit of two hands available in a stable environment. The sailor's hands and fingers may be cold and wet. Tools are not available. Thus, a truly workable mast foot adjusting system should be workable on the water, with wet hands, and, most importantly, with one hand. In extreme weather or surf conditions which may arise, a sailor may wish or need to remove the mast 12 from its attachment to the board 12 and lay it on the board 12 with the sail 16 and boom 14 in a furled conditions so that the sailor can lay on them on the board 12 and hand paddle the board 12 back to shore. Thus, the ideal mast foot adjusting system should permit easy release of the mast 12 from the holding and adjusting portions carried by the board 10—again, on the water and preferably with one wet and cold hand.

Wherefore, it is an object of the present invention to provide a mast foot holding and adjusting system for use with the mast of a windsurfing board, or the like, which allows fore and aft adjusting of the position of the mast on a mast track in the top surface of the board in a manner which is quick and simple and which can be accomplished on the water with one hand.

It is another object of the present invention to provide a mast foot holding and adjusting system for use with the mast of a windsurfing board, or the like, which allows the mast to be released from a holding and adjusting portion carried by a mast track in the top surface of the board in a manner which is quick and simple and which can be accomplished on the water with one hand.

It is still another object of the present invention to provide a mast foot holding and adjusting system for use with the mast of a windsurfing board, or the like, which allows the mast to be released from a holding and adjusting portion carried by a mast track in the top surface of the board by employing a one hand operable cam lever while providing a more secure two point gripping of the mast track wherein the two gripping points are simultaneously released by the action of the cam lever.

Other objects and benefits of the present invention will become apparent from the description which follows hereinafter when taken in conjunction with the drawing figures which accompany it.

SUMMARY

The foregoing objects have been achieved by the mast foot assembly of the present invention for adjustably and releasably holding a mast to a mast track having a slot in a planar member with upper and lower surfaces and disposed on a surface of a sailing device comprising, a base member disposed on the upper surface of the mast track and having a pair of first bores at respective ends thereof disposed over the slot, the base member having a central mounting portion between the first bores with a second bore therethrough normal to the upper and lower surfaces and having a first slot communicating between a side of the base member and the second bore; a retaining key member sized to slidably fit within the first slot in the base member and having a second slot communicating with an inner end thereof; a pair of nut members each having a treaded bore therein disposed under the lower surface of the mast track; a pair of threaded members carried by the base member and passing through respective ones of the first bores in threaded engagement with respective ones of the nut members, the threaded members each having a head portion unable to pass through the first bore associated therewith; a cylindrical pivot and retaining pin carried by a lower end of the mast and having a circumferential groove aligned with the first slot with the mast disposed on the base member with the pin disposed in the second bore, the retaining key member being slidable into the first slot to have portions simultaneously engaged with the first slot and the groove to pivotally retain the pin in the second bore and being slidable out of the first bore to allow the pin and the mast carrying it to be removed from the base portion; and, cam handle means carried by the base portion with the threaded members passing therethrough for simultaneously creating or releasing a lifting force on the head portion of the threaded members.

In the preferred embodiment, there are a pair of semicylindrical head support members holding the head portion of respective ones of the threaded members wherein the cam handle means includes a pair of semicylindrical sockets holding respective ones of the head support members and having walls disposed between the head support member and a top surface of the base portion tapering from one thickness to another whereby the cam handle means can be rotated about the head support members to simultaneously create and release a lifting force on the head portion of the treaded members.

Additionally in the preferred embodiment, the retaining key member has a notch in a side edge thereof and the base portion includes spring biased latch means for releasably engaging the notch to hold the key member in the first slot. Also, the preferred retaining key member has a ring formed in an outer end thereof onto which a cord can be tied to retain the key member from loss.

DESCRIPTION OF THE PREFERRED EMBODIMENT

Figure 3:
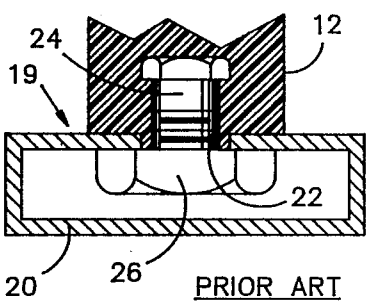
PRIOR ART FIG. 3
FIG. 3 is a simplified cutaway drawing of the mast track box of FIG. 2 in the plane III—III.
Figure 2:
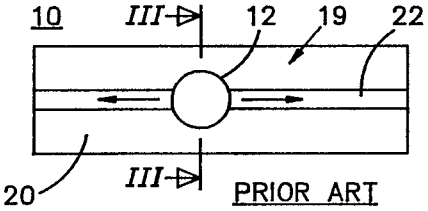
PRIOR ART FIG. 2
FIG. 2 is a simplified top view of a prior art mast track box as incorporated into the top surface of a windsurfing board to permit longitudinal adjustment of a mast attached thereto.
Figure 1:
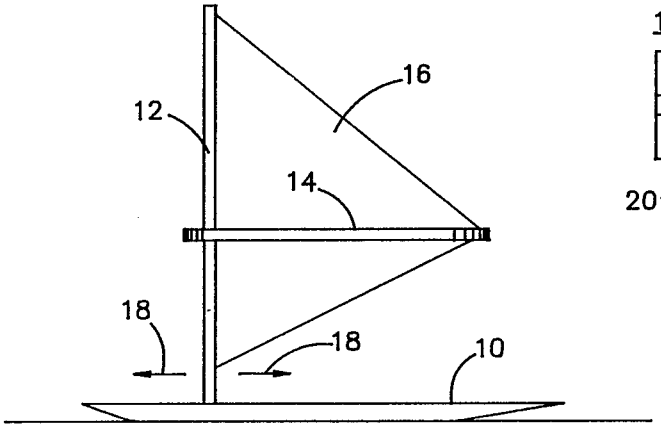
PRIOR ART FIG. 1
FIG. 1 is simplified drawing of a prior art windsurfing board as wherein the present invention is applicable.
Figure 4:
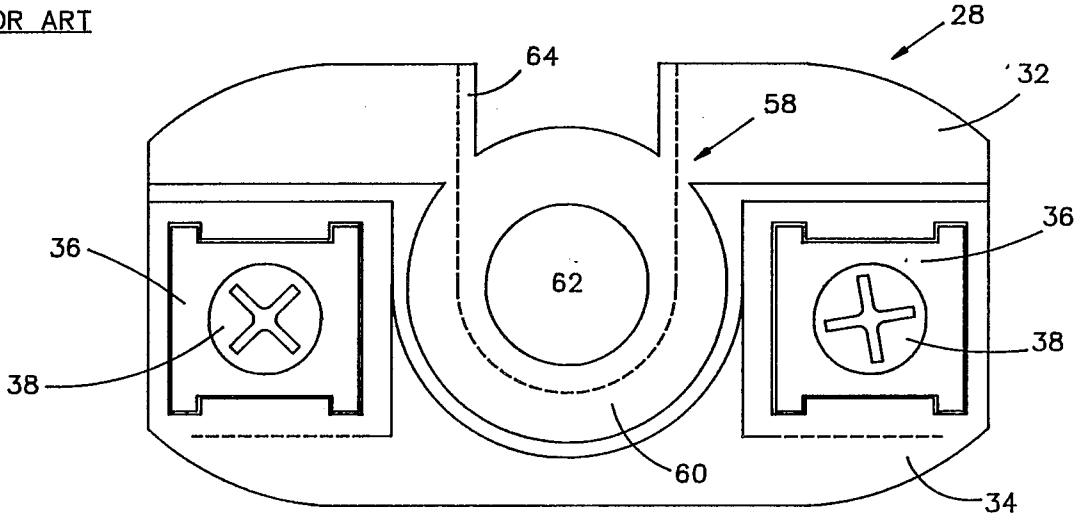
FIG. 4 is a plan view of the cam operated mast foot of the present invention in assembled form.
Figure 5:
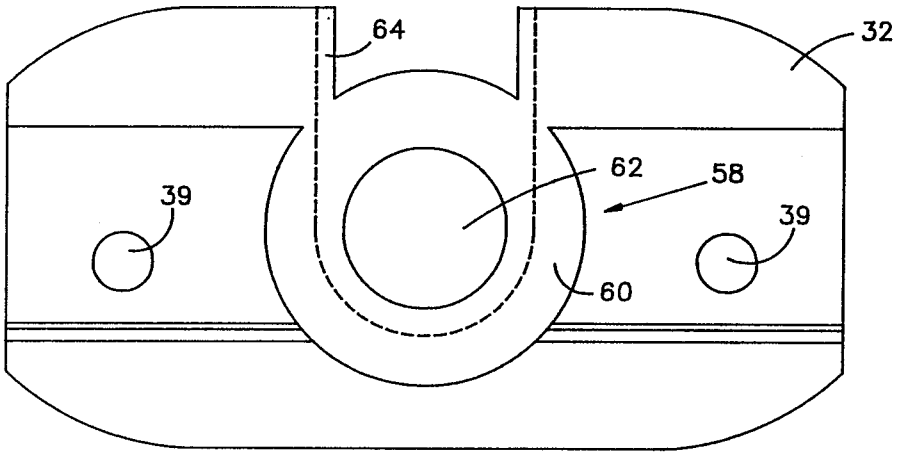
FIG. 5 is a plan view of the base portion of the mast foot of the present invention.
Figure 7:
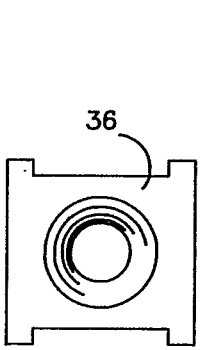
FIG. 7 is a plan view of one of the two screw head supports employed in the mast foot of the present invention.
Figure 8:
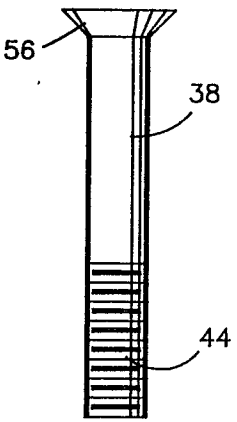
FIG. 8 is a side view of one of the two machine screws employed in the mast foot of the present invention.

The mast foot adjusting system of the present invention is depicted in FIGS. 4 through 16. The system is sold commercially by the assignee of this application under the trademark CamFoot. There are two portions to the system in its preferred embodiment as will be described hereinafter. The first is cam foot assembly 28 as depicted in assembled form in FIG. 4. The cam foot assembly 28 is carried by the board 10 in association with a mast track 19 substantially like that described above. The second portion is a pivot and retaining pin 30 carried by the mast (or a bottom portion thereof) as depicted in FIGS. 15 and 16, which will be described later herein.

Figure 6:
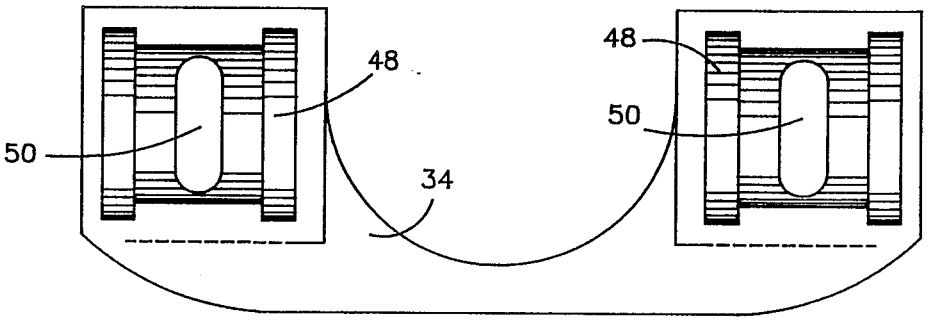
FIG. 6 is a plan view of the cam handle portion of the mast foot of the present invention.
Figure 9:
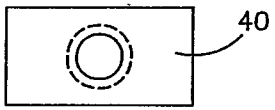
FIG. 9 is a plan view of one of the two nut members employed in the mast foot of the present invention.
Figure 12:
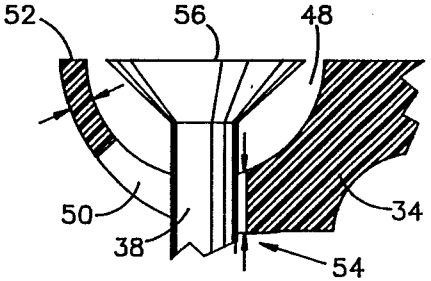
FIG. 12 is cutaway side view through one of the screw head supports and the cam handle showing the sizing thereof which creates the camming force.

The cam foot assembly 28 comprises a base portion 32, a cam handle portion 34, two screw head supports 36, two standard machine screws 38, and two threaded nut members 40. These components are depicted individually in FIGS. 5–9. The screws 38 and members 40 are preferably of a suitable metal which will not rust while the remaining portions are preferably of one of the durable plastics presently available and well known to those skilled in the art. As best seen from the end view of FIG. 10, the base portion 32 sits on the top surface 42 of the mast track 19. The threaded portion 44 of each machine screw 38 passes through the slot 22 and bores 39 in the base portion 32 into threaded engagement with the nut members 40. By turning the nut members 40 in a clockwise direction, the position of the nut members 40 with respect to the base portion 32 can be adjusted to bring the nut members 40 into contact with the bottom surface 46 of the top of the mast track 19 to effect the operability of the system in a manner now to be described. As best seen from the drawing of FIG. 11, the screw head supports 36 are semi-cylindrical in shape. As depicted in FIGS. 6 and 12, the cam handle portion 34 contains a semi-cylindrical socket 48 at each end thereof into which the screw head supports 36 fit. Each socket 48 has a transverse slot 50 in the bottom thereof through which the machine screw 38 being held by the respective support 36 passes. As can be appreciated, as a result of the above-described construction, with the components assembled as shown and the nut members 40 not tightened too tightly, the cam handle portion 34 can be rotated about the screw head supports 36.

Figure 14:
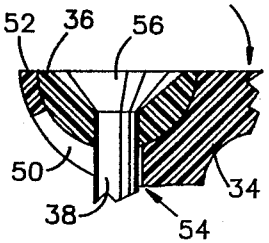
FIG. 14 is a side view showing the cam handle in its locked state.
Figure 13:
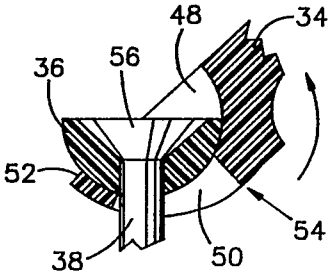
FIG. 13 is a side view showing the cam handle in its released state.
Figure 10:
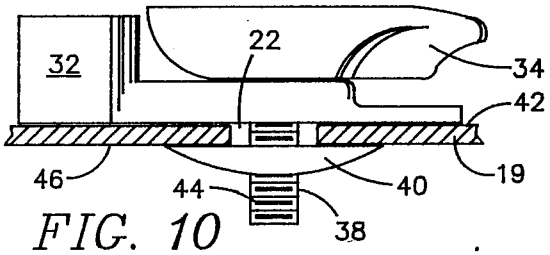
FIG. 10 is an end view of the mast foot of the present invention in its locked position.

As depicted in FIG. 12, the thickness of the cam handle portion 34 in the area of the socket 48 is thinner adjacent the upper edge 52 than it is at the bottom of the slot 50 at 54. This change in thickness is a smooth transition. Thus, as the cam handle portion 34 is rotated between a raised position with the upper edge 52 adjacent the bottom of the socket 48 as depicted in FIG. 13 and a lowered position with the bottom of the slot 54 adjacent the bottom of the socket 48 as depicted in FIG. 14, a camming action is created which urges the screw head supports 36 upward against the heads 56 of the machine screws 38. As can be appreciated, if the position of the nut members 40 on the machine screws 38 is properly set, when the cam handle portion is moved to the lowered position the top and bottom surfaces 42, 46 of the mast track 19 can be squeezed between the base portion 32 and the nut members 40 sufficiently to hold the cam foot assembly 28 in a given position on the mast track 19. Conversely, by raising the cam handle portion 34, the above-described squeezing and holding force can be released (with one hand) to allow the cam foot assembly 28 to be moved longitudinally. Thus, with the cam foot assembly 28 as above-described, the stated objective relative to a one-handed releasable foot holding apparatus can be seen to have been achieved.

Figure 16:
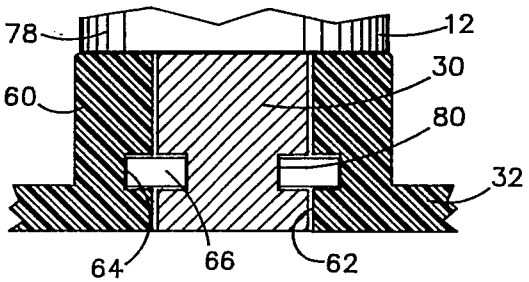
FIG. 16 is a cutaway elevation view showing how the retaining key member fits into the base portion to pivotally hold the mast thereto.
Figure 11:
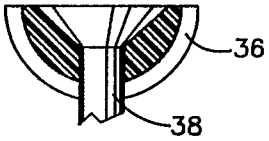
FIG. 11 is a partially cutaway side view of one of the screw head supports of the present invention.
Figure 15:
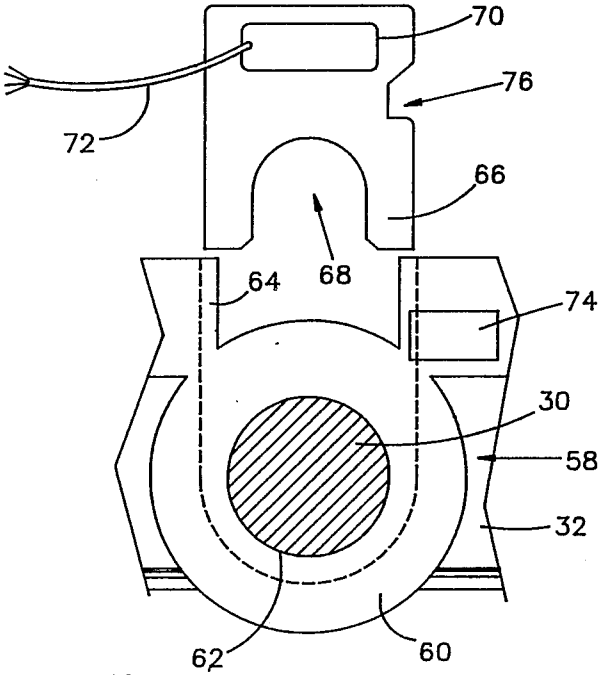
FIG. 15 is a plan view drawing showing how the retaining key member fits into the base portion to pivotally hold the mast thereto.

Turning to FIGS. 15 and 16 with particularity, we will now address the second main object of the present invention—easy release of the mast from the above-described foot holding apparatus. As shown in FIG. 15, the center of the base portion 32 comprises a cylindrical socket 58 having a cylindrical support portion 60 with a concentrically located bore 62 therethrough. A slot 64 extends from the side of the base portion 32 into the cylindrical socket 58. A metal retaining key member 66 is sized to slide snugly within the slot 64. The key member 66 has a slot 68 communicating with the inner end and a ring 70 formed into the outer end. The ring 70 can be gripped for pulling the key member 66 from the slot 64 or, preferably, has a cord 72 attached thereto which can be fastened in the area of the mast foot to prevent loss and, additionally, can be pulled to remove the key member 66 from the slot 64 when it is desired to remove the mast from the cam foot assembly 28. If desired, a spring-loaded latch 74 can be incorporated into the base portion 32 to interact with a notch 76 provided in the key member 66 to prevent the key member 66 from coming out of the slot 64 at undesired times. As shown in FIG. 16, a cylindrical pivot and retaining pin 30 is mounted to an end portion of the mast 12 (i.e. a flexible mast joint 78) to extend longitudinally therefrom. The pin 30 has a circumferential groove 80 therein positioned to align with the slot 64 when the pin 30 is inserted into the bore 62 with the flexible mast joint 78 resting on the top of the support portion 60. By inserting the key member 66 into the aligned slot 64 and groove 80 as depicted in FIG. 16, the pin 30 (and thereby the mast 12) is held to the cam foot assembly 28 while being free to pivot as needed to prevent undue twisting strain on the mast 12. Thus, as can be appreciated from the foregoing description, the second major object of the present invention is also achieved by the above-described apparatus of the present invention.

Thus, as should be readily apparent to those skilled in the art from the foregoing description and accompanying drawings, the CamFoot TM mast foot holding, adjusting, and releasing apparatus of the present invention has many novel and unique features. With all the components assembled as shown, a single action of the cam handle portion (which can be accomplished on the water with one hand) tightens or releases both cams (and both gripping points) simultaneously, allowing adjustment of the apparatus fore and aft in the mast track. Without the cam handle portion attached, the cam foot assembly can be used as a fixed, two-point-attachment mast foot by hand tightening the machine screws at the ends of the base portion into the nut members—with the easy-release feature of the mast from the base retained.

Wherefore, having thus described the present invention, what is claimed is:

1. A mast foot assembly for adjustably and releasably holding a mast to a mast track having a slot in a planar member with upper and lower surfaces and disposed on a surface of a sailing device comprising:

(a) a base member disposed on the upper surface of the mast track and having a pair of first bores at respective ends thereof disposed over said slot, said base member having a central mounting portion between said first bores with a second bore therethrough normal to the upper and lower surfaces and having a first slot communicating between a side of said base member and said second bore;

(b) a retaining key member sized to slidably fit within said first slot in said base member and having a second slot communicating with an inner end thereof, said retaining key member further having a notch in a side edge thereof;

(c) a pair of nut members each having a treaded bore therein disposed under the lower surface of the mast track;

(d) a pair of threaded members carried by said base member and passing through respective ones of said first bores in threaded engagement with respective ones of said nut members, said threaded members each having a head portion unable to pass through said first bore associated therewith; and, (e) a cylindrical pivot and retaining pin carried by a lower end of the mast and having a circumferential groove aligned with said first slot with the mast disposed on said base member with said pin disposed in said second bore, said retaining key member being slidable into said first slot to have portions simultaneously engaged with said first slot and said groove to pivotally retain said pin in said second bore and being slidable out of said first bore to allow said pin and the mast carrying it to be removed from said base portion; and wherein additionally, (f) said base portion includes spring biased latch means for releasably engaging said notch to hold said key member in said first slot.

2. The mast foot assembly of claim 1 and additionally comprising:

cam handle means carried by said base portion with said threaded members passing therethrough for simultaneously creating or releasing a lifting force on said head portion of said threaded members.

3. The mast foot assembly of claim 2 and additionally comprising:

(a) a pair of semi-cylindrical head support members holding said head portion of respective ones of said threaded members; and wherein, (b) said cam handle means includes a pair of semi-cylindrical sockets holding respective ones of said head support members and having walls disposed between said head support member and a top surface of said base portion tapering from one thickness to another whereby said cam handle means can be rotated about said head support members to simultaneously create and release a lifting force on said head portion of said threaded members.

4. A mast foot assembly for adjustably holding a mast to a mast track having a slot in a planar member with upper and lower surfaces and disposed on a surface of a sailing device comprising:

(a) a base member disposed on the upper surface of the mast track and having a pair of first bores at respective ends thereof disposed over said slot;

(b) a pair of nut members each having a treaded bore therein disposed under the lower surface of the mast track;

(c) a pair of threaded members carried by said base member and passing through respective ones of said first bores in threaded engagement with respective ones of said nut members, said threaded members each having a head portion unable to pass through said first bore associated therewith;

(d) cam handle means carried by said base portion with said threaded members passing therethrough for simultaneously creating or releasing a lifting force on said head portion of said threaded members;

(e) means for holding the mast to the base member;

(f) a pair of semi-cylindrical head support members holding said head portion of respective ones of said threaded members; and, (g) a pair of semi-cylindrical socket means included within said cam handle means for holding respective ones of said head support members and having walls disposed between said head support member and a top surface of said base portion tapering from one thickness to another for simultaneously creating or releasing a lifting force on said head portion of said treaded members when said cam handle means is rotated about said head support members.

5. The mast foot assembly of claim 4 wherein said means for holding the mast to the base member comprises:

(a) said base member having a central mounting portion between said first bores with a second bore therethrough normal to the upper and lower surfaces and having a first slot communicating between a side of said base member and said second bore;

(b) a retaining key member sized to slidably fit within said first slot in said base member and having a second slot communicating with an inner end thereof; and, (c) a cylindrical pivot and retaining pin carried by a lower end of the mast and having a circumferential groove aligned with said first slot with the mast disposed on said base member with said pin disposed in said second bore, said retaining key member being slidable into said first slot to have portions simultaneously engaged with said first slot and said groove to pivotally retain said pin in said second bore and being slidable out of said first bore to allow said pin and the mast carrying it to be removed from said base portion.

6. The mast foot assembly of claim 5 wherein:

(a) said retaining key member has a notch in a side edge thereof; and wherein additionally, (b) said base portion includes spring biased latch means for releasably engaging said notch to hold said key member in said first slot.

7. A mast foot assembly for adjustably and releasably holding a mast to a mast having a slot in a planar member with upper and lower surfaces and disposed on a surface of a sailing device comprising:

(a) base member disposed on the upper surface of the mast track and having a pair of first bores at respective ends thereof disposed over said slot, said base member having a central mounting portion between said first bores with a second bore therethrough normal to the upper and lower surfaces and having a first slot communicating between a side of said base member and said second bore;

(b) a retaining key member sized to slidably fit within said first slot in said base member and having a second slot communicating with an inner end thereof;

(c) a pair of nut members each having a treaded bore therein disposed under the lower surface of the mast track;

(d) a pair of threaded members carried by said base member and passing through respective ones of said first bores in threaded engagement with respective ones of said nut members, said threaded members each having a head portion unable to pass through said first bore associated therewith;

(e) a cylindrical pivot and retaining pin carried by a lower end of the mast and having a circumferential groove aligned with said first slot with the mast disposed on said base member with said pin disposed in said second bore, said retaining key member being slidable into said first slot to have portions simultaneously engaged with said first slot and said groove to pivotally retain said pin in said second bore and being slidable out of said first bore to allow said pin and the mast carrying it to be removed from said base portion;

(f) cam handle means carried by said base portion with said threaded members passing therethrough for simultaneously creating or releasing a lifting force on said head portion of said threaded members; and, (g) a pair of semi-cylindrical head support members holding said head portion of respective ones of said threaded members; and wherein, (h) said cam handle means includes a pair of semi-cylindrical sockets holding respective ones of said head support members and having walls disposed between said head support member and a top surface of said base portion tapering from one thickness to another whereby said cam handle means can be rotated about said head support members to simultaneously create or release a lifting force on said head portion of said treaded members.

8. The mast foot assembly of claim 7 wherein:

(a) said retaining key member has a notch in a side edge thereof; and wherein additionally, (b) said base portion includes spring biased latch means for releasably engaging said notch to hold said key member in said first slot.

* * * * *